United States Patent [19]

Barnett et al.

[11] Patent Number: 4,861,429

[45] Date of Patent: Aug. 29, 1989

[54] PROCESS FOR INHIBITING WHITE PITCH DEPOSITION IN PAPERMAKING FELTS

[75] Inventors: Daniel J. Barnett; Daniel L. Michalopoulos, both of Jacksonville, Fla.

[73] Assignee: Betz Laboratories, Inc., Trevose, Pa.

[21] Appl. No.: 225,978

[22] Filed: Jul. 29, 1988

[51] Int. Cl.[4] ..... D21F 1/32

[52] U.S. Cl. ..... 162/199; 162/DIG. 4

[58] Field of Search ..... 162/DIG. 4, 199; 252/351

[56] References Cited

U.S. PATENT DOCUMENTS

| | | | |
|---|---|---|---|
| 3,398,047 | 8/1968 | Michalski | 162/48 |
| 3,748,220 | 7/1973 | Gard | 162/190 X |
| 3,873,417 | 3/1975 | Otrhalek | 162/168 |
| 3,992,249 | 11/1976 | Farley | 162/72 |
| 4,184,912 | 1/1980 | Payton | 162/72 |
| 4,251,363 | 2/1981 | Chamberlain et al. | 210/727 |
| 4,652,377 | 3/1987 | Amjad | 162/DIG. 4 X |
| 4,715,931 | 12/1987 | Schellhamer et al. | 162/199 |
| 4,732,698 | 3/1988 | Chen | 252/181 |
| 4,759,851 | 7/1988 | Chen | 210/697 |
| 4,781,794 | 11/1988 | Moreland | 162/199 |

FOREIGN PATENT DOCUMENTS 8109698 6/1983 Japan .

OTHER PUBLICATIONS

Latimer, "Predicting 'White Pitch' Problems", Tappi, vol.62, No. 5, pp. 29–31, May 1979.

Casey, *Pulp and Paper,* Third Edition, vol. III, p. 1584, 1981

Shelton, "Using Talc to Control Pitch Problems in Paper and Pulp Mills", *Paper Trade Journal,* pp. 48–49, Aug. 1985.

Edwards, "Wet End Chemical Control Reduces Recycled Coated Stock Problems", *Pulp and Paper,* pp. 52–54, Feb. 1987.

*Primary Examiner*—Peter Chin

*Assistant Examiner*—Thi Dang

*Attorney, Agent, or Firm*—Alexander D. Ricci; Steven D. Boyd

[57] ABSTRACT

This invention relates to a process for inhibiting white pitch deposition in felts of a papermaking system including adding to the felts an effective inhibiting amount of an organic, anionic polyelectrolyte. The molecular weight of the polyelectrolyte is preferably from about 1,000 to 100,000. The polyelectrolyte is selected from the group consisting of polyacrylic acid, polmethacrylic acid, acrylic acid/polethylene glycol allyl ether copolymers, methacrylic acid/polyethylene glycol allyl ether copolymers, acrylic acid/1-allyloxy-2-hydroxypropane sulfonic acid copolymers. The use of these polyelectrolytes in combination with surfactants provides an especially effective white pitch inhibiting and total felt conditioning process when applied to the felt.

19 Claims, No Drawings

PROCESS FOR INHIBITING WHITE PITCH DEPOSITION IN PAPERMAKING FELTS

FIELD OF THE INVENTION

This invention relates to inhibiting deposition of white pitch in the felts of a papermaking system. More particularly, this invention relates to inhibiting white pitch deposition in the wet press section felts of a papermaking machine wherein the felts are prone to such deposition and the felts are conditioned by showering with an aqueous medium.

BACKGROUND OF THE INVENTION

The utilization of repulped, latex-coated paper or paperboard as a component of a paper or paperboard pulp furnish places severe demands on the papermaking machines wet press felt conditioning system. Based upon the typical coating weights in normal use of such repulped material, the potential non-fibrous press felt contaminants can be 5 to 10 times higher than in a papermaking furnish not containing repulped, coated material. This high level of contaminating material can plug or foul the papermaking felts, severely impairing their water absorbing capabilities which, in turn, reduces machine production rates, produces paper quality defects and/or requires premature removal and replacement of the felts all leading to increased operating costs and lost production time.

Chemical analysis of used press felts which have been subjected to this type of contamination indicate the presence of significant quantities of paper coating components such as polyvinyl acetate or styrene-butadiene latex binders as well as inorganic coating pigments such as clay, calcium carbonate and titanium dioxide. In many cases, the analysis also revealed relatively small amounts of natural wood resins such as fatty esters, fatty acids, resin acids, and other typical papermaking furnish components such as sizing agents, alumina and fiber fines. Although variable in composition, this type of chemical contamination is known generally as white pitch. It is important to note, therefore, that white pitch is significantly different chemically than normally occurring wood pitch; accordingly, treatments for one will not necessarily be successful for the other.

Effective chemical conditioning of a press felt helps to reduce the rate of felt compaction, maintain maximum felt absorbency and prolong the felts useful operating life. A felt must be kept clean of filling materials, such as white pitch, which adheres to the felt fibers and accumulates in the felt structure. The filling materials not only impede the flow of water through the felt, but also create adhesion between felt fibers thus increasing the tendency for the felt structure to compact and lose absorption capacity. Prior art felt conditioners have proven to possess limited efficiency against white pitch contamination at commercially acceptable treatment dosage levels.

SUMMARY OF THE INVENTION

The present invention relates to a process for inhibiting the deposition of white pitch in felts of a papermaking machine when repulped paper or paperboard is a component of the pulp furnish. The process comprises adding to the felt an effective inhibiting amount of one or more organic, anionic polyelectrolytes. The organic, anionic polyelectrolytes of the present invention may be applied singly or in combination with prior art nonionic surfactants. The polyelectrolytes are preferably applied by one or more fresh water showers directed onto a press felt on its run between the press nip and the suction (Uhle) box. The organic, anionic polyelectrolyte is preferrably selected from the group consisting of: polyacrylic acid, polymethacrylic acid, acrylic acid/-polyethylene glycol allyl ether copolymer, methacrylic acid/polyethylene glycol allyl ether copolymer, acrylic acid/1-allyloxy-2-hydroxypropane sulfonic acid copolymer. The molecular weight of the polyelectrolyte is preferrably from about 500 to about one million and, preferrably from about 1,000 to about 100,000. The organic, anionic polyelectrolyte of the present invention is preferrably continuously spray applied in an aqueous medium comprising from about 10 to about 1,000 parts polyelectrolyte per million parts of water and preferrably from about 20 to about 150 ppm polyelectrolyte. The molar ratio of the monomers in the copolymers of the present invention preferrably fall within the range of from about 30:1 to about 1:20 and more preferrably within the range of from about 10:1 to about 1:10.

The use of these organic, anionic polyelectrolytes alone or in combination with nonionic surfactants known in the art for controlling organic contaminants in the felt such as wood pitch components or rosin, provides an especially effective felt conditioning process for felts exposed to pulp furnish containing repulped coated materials.

Accordingly, it is one object of the present invention to provide processes for inhibiting white pitch deposition in felts of the papermaking system. It is a further object of the present invention to inhibit white pitch deposition in the wet press section felt of a papermakers machine wherein the felt is prone to such deposition, and where the felt is conditioned by showering with an aqueous medium. These and other objects and advantages of the present invention will be apparent to those skilled in the art upon reference to the following description of the preferred embodiments.

DESCRIPTION OF THE PREFERRED EMBODIMENTS

The present invention relates to a process for inhibiting white pitch deposition in a felt in the wet press section of a papermaking system which employs repulped coated materials as a part of the pulp furnish. The felt is conditioned by showering with an aqueous medium which comprises an effective inhibiting amount of an organic, anionic polyelectrolyte. Exemplary polyelectrolytes include, polyacrylic acid, polymethacrylic acid, acrylic acid/polyethylene gycol allyl ether copolymer, methacrylic acid/polyethylene glycol allyl ether copolymer and acrylic acid/1-allyloxy-2-hydroxypropane sulfonic acid copolymer. The number average molecular weight of the polyelectrolytes, while not critical, is preferrably between about 500 and 1 million and most preferrably between about 1,000 to 100,000. The molar ratio of the copolymers is preferrably between 30:1 and 1:20 and most preferrably between about 10:1 and 1:10. It is important that the polyelectrolyte be water soluble.

The organic, anionic polyelectrolytes of the present invention are compounds which have chemical and structural features that provide unexpected efficiency in inhibiting white pitch deposition in the felts of papermaking systems. Typical prior art felt conditioning mechanisms relied upon surfactant emulsification of contaminants; acid, caustic or solvent solubilization of same; and/or surfactant wetting of the felt fibers rendering them less receptive to the attachment of hydrophobic contaminant particles. It is surprising, then, that the object organic anionic polyelectrolytes function in the present invention and to such a high degree. This is especially true when one, skilled in the art, considers that the mechanically induced hydraulic forces associated with the felt passing through the press nip of a paper machine are great enough to overcome the repulsive forces, instilled by the polyelectrolyte, between the anionically charged colloidal contaminants to afford them the opportunity to agglomerate and become entrapped within the felt. The organic, anionic polyelectrolytes of the present invention are believed to be adsorbed onto the weakly anionically charged colloidal white pitch particles. This induces a strong anionic charge and inter-particle repulsion which inhibits the coalescing of the white pitch particles. Thus, the white pitch particles are inhibited from coalescing into macroscopic deposits which become embedded into the felt structure.

It is important that the organic, anionic polyelectrolytes of the present invention be water soluble to allow application to be via conventional felt conditioning means. Also, the white pitch controlling compounds as well as any additional organic deposit controlling compounds of the felt conditioner must be capable of acting within a short time span. This is due to the fact that the distance of felt travel between the felt conditioner application points (usually a shower from which the aqueous medium is sprayed) and the felt suction (Uhle) box are typically only several tens of feet apart. At present day machine speeds of up to several thousand feet per minute, this only leaves a response time on the order of seconds before the bulk of the felt conditioner components (along with any entrained contaminants) are removed from the felt by the suction box.

It has been found that the organic, anionic polyelectrolytes of the present invention which are effective at controlling white pitch may be used in combination with known nonionic surfactants which control organic resins such as fatty esters and fatty acids. Examples of surfactants which may be utilized in accordance with this invention include: octyl phenol ethoxylates:

$$C_8H_{17}\text{--}C_6H_4\text{-}O\,(CH_2CH_2O\,)N_1\text{--}CH_2CH_2OH$$

where N=9–30; nonyl phenol ethoxylates:

$$C_9H_{19}\text{--}C_6H_4\text{--}O(CH_2CH_2O)_{N\text{-}1}\text{--}CH_2CH_2OH$$

where N=9–40; dodecyl phenol ethoxylates:

$$C_{12}H_{25}\text{--}C_6H_4\text{--}O(CH_2CH_2O)_{N\text{-}1}\text{--}CH_2CH_2OH$$

where N=9–40; primary alcohol ethoxylates;

$$CH_3\text{--}(CH_2)_X\text{--}CH_2O(CH_2CH_2O)_{N\text{-}1}\text{--}CH_2CH_2OH$$

where N=12–30 and X-10–13; secondary alcohol ethoxylates;

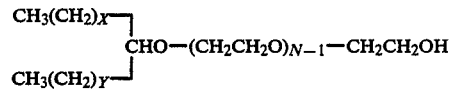

where N=12–30, X=9–12 and Y=9–12; propoxylated polyoxyethylene glycols:

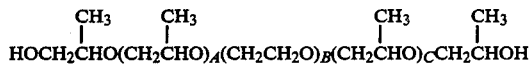

where A=C=2000–5000 molecular weight and possibly greater; and B=1,300–15,000 molecular weight and possibly greater; ethoxylated polyoxypropylene glycols:

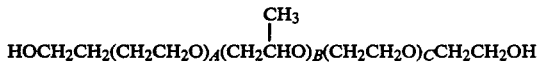

where A=C=1,300–5,000 molecular weight and possibly greater and B=2,000–5,000 molecular weight and possibly greater; dialkyl phenol ethoxylates:

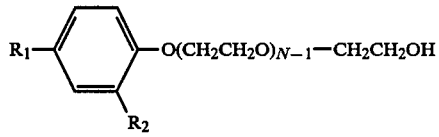

where N=9–40, $R_1=C_8H_{17}$, $C_9H_{19}$ or $C_{12}H_{25}$, and $R_2=C_8H_{17}$, $C_9H_{19}$ or $C_{12}H_{25}$; polyoxyethylene sorbitan monoester:

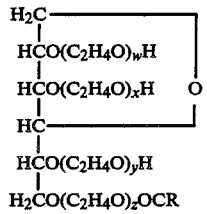

where x+y+w+z =10–30 and R=lauric, palmitic, stearic or oleic.

The amounts or concentrations of the aforesaid organic, anionic polyelectrolytes and surfactants can vary depending on, among other things, the pH of the aqueous medium, the volume of the felt shower water applied, the concentration of white pitch contaminants and the concentration of other organic contaminants. From the disclosure of this invention, it would be within the capability of those skilled in the arts to find by experimentation the optimum amounts or concentrations of the polyelectrolyte or the surfactant for any particular system. Generally, the total amount of either polyelectrolyte or surfactant which is added to the aqueous medium is from about 10 parts to about 1,000 parts per million parts of the aqueous medium. Preferably, both the polyelectrolyte and surfactant are added in an amount from about 20 to about 150 parts per million.

The aforementioned polyelectrolytes and surfactants are generally presently available commercially. These compounds can be added to the aqueous medium by any conventional method. Preferably the pH of the aqueous medium is from about 3 to about 10. The aqueous medium can be shower water which is sprayed from showerheads onto the felt in the press section of the typical papermaking system known in the art. The aqueous medium may contain other additives, such as solvents, acids, alkalis, etc. which are compatible with the polyelectrolytes and surfactants utilized in accordance with the present invention. In order to more clearly illustrate the invention, the data set forth below was developed. The following example is included as being an illustration of the invention and should not be construed as limiting the scope thereof.

EXAMPLE

Tests were conducted to study the effect of the organic, anionic polyelectrolytes of the present invention as well as prior art nonionic surfactants to control white pitch deposition. A continuous press felt conditioning test apparatus and a simulated contaminant system was employed. The test incorporated a clean (unused) press felt sample of known initial weight and permeability. The felt sample was placed on a heavy mesh screen through which treated or untreated contaminant solution was pressed.

The simulated papermaking white pitch contaminant test slurry consisted of the following:

TABLE I

| Ingredient | Concentration (ppm) |
|---|---|
| Fatty ester/fatty acid pitch mixture | 100 |
| Abietic Acid | 50 |
| *Coating Solids (cured,redispersed 15% slurry) | 900 |
| Alum ($Al_2(SO_4)_3.17H_2O$ | 75 |
| $CaCl_2$(as Ca) | 100 |

*Pre-cured coating contains: 5% polyvinylacetate latex, 5% styrene-butadiene rubber latex, 32% clay, 8% $TiO_2$ and 50% water.

This simulated contaminant was employed in testing the performance characteristics of several nonionic surfactants and the organic, anionic polyelectrolytes of the present invention.

Table II outlines the performance characteristics tested:

TABLE II

| Conditioning Agent | Treatment Concentration (ppm) | % Weight Gain (over clean control) | % Permeability Decrease (from clean control) |
|---|---|---|---|
| (Untreated Control) | — | 26.1 | 67.8 |
| Ethoxylated octylphenol-A | 150 | 16.4 | 45.7 |
| Ethoxylated octylphenol-B | 150 | 27.1 | 57.9 |
| Ethoxylated nonylphenol-A | 40 | 20.8 | 52.8 |
| | 75 | 8.1 | 32.3 |
| Ethoxylated nonylphenol-B | 40 | 17.6 | 49.6 |
| | 75 | 7.0 | 34.1 |
| Ethoxylated dialkylphenol-A | 150 | 11.7 | 38.6 |
| Ethylene oxide/propylene oxide block polymer-A | 150 | 13.8 | 49.3 |
| Ethylene oxide/propylene oxide block polymer-B | 80 | 6.6 | 32.7 |
| | 150 | 4.4 | 26.4 |
| Ethoxylated nonylphenol blend | 83 | 11.0 | 39.9 |
| | 103 | 8.1 | 35.6 |
| | 124 | 6.5 | 29.4 |
| Acrylic acid/polyethylene glycol allyl ether-A | 45 | 2.6 | 22.5 |
| Acrylic acid/polyethylene glycol allyl ether-B | 20 | 5.2 | 24.8 |
| | 45 | 2.4 | 23.0 |
| Methacrylic acid/ polyethylene glycol allyl ether - A | 38 | 3.3 | 25.9 |
| Methacrylic acid/ polyethylene glycol allyl ether - B | 38 | 4.2 | 24.6 |
| Polyacrylic acid homopolymer - A | 20 | 7.6 | 34.0 |
| | 40 | 6.2 | 27.6 |
| Polyacrylic acid homopolymer - B | 20 | 4.3 | 24.0 |
| | 40 | 2.4 | 23.6 |
| Polyacrylic acid homopolymer - C | 20 | 5.5 | 27.0 |
| | 56 | 2.6 | 19.5 |
| Polymethacrylic acid homopolymer-A | 20 | 6.4 | 23.4 |
| acrylic acid/1-allyloxy-2-hydroxy propane sulfonic acid-A | 50 | 5.1 | 28.9 |
| 1:1 Anionic polyelectrolyte: ethoxylated nonylphenol blend | 25 | 6.2 | 29.0 |
| | 50 | 4.8 | 29.7 |
| | 100 | 2.3 | 21.5 |
| | 140 | 1.8 | 21.2 |

The test results reported in Table II demonstrate the efficiency of the organic, anionic polyelectrolytes of the present invention in inhibiting white pitch deposition in paper machine felts. Furthermore, the relative inefficiency of the prior art nonionic surfactants alone to control white pitch deposition is shown as is the ability of the polyelectrolytes of the present invention to work in combination with prior art nonionic surfactants.

While this invention has been described with respect to particular embodiments thereof, it is apparent that the numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting the deposition of white pitch in felts of a papermaking system which comprises applying to said felts an effective inhibiting amount of one or more organic, anionic polyelectrolytes in an aqueous spray.

2. The process of claim 1 wherein said aqueous spray includes one or more nonionic surfactants.

3. The process of claim 2 wherein said nonionic surfactants are selected from the group consisting of octyl phenol ethoxylates, nonyl phenol ethoxylates, dodecyl phenol ethoxylates, primary alcohol ethoxylates, secondary alcohol ethoxylates, propoxylated polyoxyethylene glycols, ethoxylated polyoxypropylene glycols, dialkyl phenol ethoxylates and polyoxyethylene sorbitan monoesters.

4. The process of claim 1, wherein said organic, anionic polyelectrolytes are selected from the group consisting of polyacrylic acid, polymethacrylic acid, acrylic acid/polyethylene glycol allyl ether copolymers, methacrylic acid/polyethylene glycol allyl ether copolymers, and acrylic acid/1-allyloxy-2-hydroxypropane sulfonic acid copolymers.

5. The process of claim 1, wherein said organic, anionic polyelectrolytes are added in an amount from about 10 parts to about 1,000 parts per million parts of said aqueous spray.

6. The process of claim 5, wherein said organic, anionic polyelectrolytes are added in an amount of from about 20 parts to about 150 parts per million parts of said aqueous spray.

7. The process of claim 4, wherein the molar ratio of monomers in said copolymers is from about 30:1 to about 1:20.

8. The process of claim 7, wherein the molar ratio of monomers in said copolymers is from about 10:1 to about 1:10.

9. The process of claim 1, wherein the molecular weight of said organic, anionic polyelectrolytes is from about 500 to about 1 million.

10. The process of claim 9, wherein the molecular weight of said organic, anionic polyelectrolytes is from about 1,000 to about 100,000.

11. A process for conditioning a press felt in a papermaking system employing repulped coated paper or paperboard as a component of a pulp furnish wherein said felt is susceptible to white pitch deposition and employing an aqueous shower is for felt conditioning, the improvement comprising adding to said aqueous shower one or more organic, anionic polyelectrolytes selected from the group consisting of polyacrylic acid, polymethacrylic acid, acrylic acid/polyethylene glycol allyl ether copolymers, methacrylic acid/polyethylene glycol allyl ether copolymers, and acrylic acid/1-allyloxy-2-hydroxypropane sulfonic acid copolymers.

12. The process of claim 11, wherein said aqueous spray includes one or more nonionic surfactants.

13. The process of claim 12, wherein said nonionic surfactants are selected from the group consisting of octyl phenol ethoxylates, nonyl phenol ethoxylates, dodecyl phenol ethoxylates, primary alcohol ethoxylates, secondary alcohol ethoxylates, propoxylated polyoxyethylene glycols, ethoxylated polyoxypropylene glycols, dialkyl phenol ethoxylates and polyoxy ethylene sorbitan monoesters.

14. The process of claim 11, wherein said organic, anionic polyelectrolytes are added in an amount from about 10 parts to about 1,000 parts per million parts of said aqueous spray.

15. The process of claim 14, wherein said organic anionic polyelectrolytes are added in an amount of from about 20 parts to about 150 parts per million parts of said aqueous spray.

16. The process of claim 11, wherein the molar ratio of monomers in said copolymers is from about 30:1 to about 1:20.

17. The process of claim 16, wherein the molar ratio of monomers in said copolymers is from about 10:1 to about 1:10.

18. The process of claim 11, wherein the molecular weight of said organic, anionic polyelectrolytes is from about 500 to about 1 million.

19. The process of claim 18, wherein the molecular weight of said organic, anionic polyelectrolytes is from about 1,000 to about 100,000.

* * * * *